US005539502A

United States Patent [19]

Koshino et al.

[11] Patent Number: 5,539,502

[45] Date of Patent: Jul. 23, 1996

[54] MULTI-CHAMBER ELECTRO-PHOTOGRAPHIC DEVELOPING UNIT FOR IMAGE FORMING APPARATUS

[75] Inventors: Toshiharu Koshino, Kadoma; Masahiko Nakamura; Toichi Matsumura, both of Hirakata; Hiroshi Komata, Itami; Kazumasa Hayashi, Osaka; Kenji Asakura, Katano; Hiroshi Komakine; Katsutoshi Ogawa, both of Hirakata, all of Japan

[73] Assignee: Matsushita Electric Industrial Co., Ltd., Osaka-fu, Japan

[21] Appl. No.: 405,874

[22] Filed: Mar. 17, 1995

[30] Foreign Application Priority Data

| | | | |
|---|---|---|---|
| Mar. 18, 1994 | [JP] | Japan | 6-048615 |
| Mar. 18, 1994 | [JP] | Japan | 6-048617 |
| Jun. 15, 1994 | [JP] | Japan | 6-132965 |

[51] Int. Cl.[6] ..... G03G 15/08

[52] U.S. Cl. ..... 355/253; 118/657

[58] Field of Search ..... 355/245, 251, 355/253; 118/653, 657, 658

[56] References Cited

U.S. PATENT DOCUMENTS

| | | | |
|---|---|---|---|
| 4,993,829 | 2/1991 | Naganuma et al. | 355/251 |
| 5,243,390 | 9/1993 | Takemoto et al. | 355/245 |

FOREIGN PATENT DOCUMENTS

| | | |
|---|---|---|
| 5-72892 | 3/1993 | Japan . |
| 5-88548 | 4/1993 | Japan . |
| 6-95506 | 4/1994 | Japan . |

*Primary Examiner*—Joan H. Pendegrass
*Attorney, Agent, or Firm*—Wenderoth, Lind & Ponack

[57] ABSTRACT

A developing unit for use in image forming apparatus includes a unit housing divided in three chambers, i.e. a toner applying chamber facing a photoreceptor and first and second toner replenishing chambers, by respective partition walls each having an opening as a passage for toner. The first and second chambers have rotation frames, respectively. Each frame has a radially extending arm to the end of which a toner transporting sheet is connected. Each sheet is provided with a friction film. When each frame rotates, the sheet with the friction film is pulled by the frame for its rotation under the toner so as to be deformed in the form of a circular arc. The toner is transported forwardly by the friction force of the friction film. When the amount of toner is reduced in each chamber, each sheet may resiliently restore to its original shape to contact the inner surface of the corresponding chamber so that a small amount of toner on the bottom of each chamber can be carried forwardly.

20 Claims, 8 Drawing Sheets

MULTI-CHAMBER ELECTRO-PHOTOGRAPHIC DEVELOPING UNIT FOR IMAGE FORMING APPARATUS

BACKGROUND OF THE INVENTION

1. Field of the Invention

The present invention relates to an electrophotographic developing unit for use in a copying machine, printer, facsimile and the like.

2. Description of the Related Art

Referring to FIG. 15, there is shown an essential part of a conventional image forming apparatus such as a printer, the apparatus comprises a photoreceptor drum 101 which is rotatable about its center axis in a direction indicated by an arrow and provided with a fixed magnet 102 therein. A corona charger 103 with a grid electrode 104 is arranged adjacent to the drum 101 at a predetermined position. The corona charger 103 charges the surface of the drum 101 at, for example −500 V. A laser beam 105 representing an image to be reproduced is radiated on the charged surface of the drum 101 so that an electrostatic latent image is formed on the surface of the drum 101. The electric potential at the latent image region exposed to the laser beam becomes, for example −100 V. A developing unit D is slantingly disposed below the passage of the laser beam 105. The developing unit D has a housing as a toner reservoir which is divided into three chambers 106, 114*a* and 114*b*. The chambers 106, 114*a* and 114*b* are, respectively, called here "a toner applying chamber, a first toner replenishing chamber and a second toner replenishing chamber". An electrode roller 107 including a fixed magnet therein is arranged in the toner applying chamber 106 such that a cylindrical surface of the roller 107 is close to the rotating surface of the drum 101. The roller 107 is rotatable in a direction indicated by an arrow. An electric voltage is applied on the roller from the alternating current/high voltage source 111. When the surface of the drum charged and radiated rotationally passes through the toner applying chamber 106, the toner is deposited on the surface in the form of magnetic brush. Thereafter, when the surface of the drum with the toner passes the roller 107, on which alternating voltage 750 V0-p superimposed by the direct current voltage −300 V is applied from the power source 111 so that the deposited toner 113 on the non-image region of the surface of the drum 101 is transferred onto the surface of the roller 107, while the toner forming the image remains on the surface of the drum 101. The transferred toner on the roller 107 is removed by a scraper 112 secured on the partition wall between the chambers 106 and 114*a*. The toner on the drum 101 corresponding to the image to be reproduced is transferred onto the copy sheet S supplied between the drum 101 and a transfer roller 118. Thereafter, the toner image on the copy sheet is fixed by passing the copy sheet through a fixing section (not shown).

As described above, the chambers 106 and 114*a* are separated by a first partition wall, and the first and second chambers 114*a* and 114*b* are separated by a second partition wall. The first and second partition walls have, respectively, toner supplying openings 115*a* and 115*b*. The toner accommodated in the second toner replenishing chamber 114*b* is transported through the second opening 115*b* into the first toner replenishing chamber 114*a*. Similarly, the toner accommodated in the first toner replenishing chamber 114*a* is transported through the first opening 115*a* into the toner applying chamber 106.

In the toner replenishing chambers 114*a* and 114*b*, there are provided rotating frames 116*a* and 116*b*, from the end portions of which toner transporting flexible sheets made of polyethylene terephthalate radially extend toward the inner surfaces of the first and second chambers 114*a* and 114*b*, respectively. As shown in FIG. 15, the two rotating frames 116*a* and 116*b* rotate in the same direction indicated by the respective arrows at the same phase angle. It is noted in the conventional toner transporting sheets 117*a* and 117*b* that the tip portions of the sheets 117*a* and 117*b* always contact the inner surfaces of the chambers 114*a* and 114*b* during the operation so that the toner in the each chamber 114*a* and 114*b* is strongly pushed out by each sheet 116*a* and 116*b* through the first and second openings 115*a* and 115*b* into the toner applying chamber 106 and the first toner replenishing chamber 114*a*.

A magnetism resistance type magnetic sensor 120 is built in the bottom wall of the first toner replenishing chamber 114*a* for the purpose of detecting the remaining amount of the toner in the first toner replenishing chamber 114*a*, so that the user can predict the timing of replacement of the developing unit.

However, the conventional developing unit has various disadvantages to be solved.

First of all, the driving torque applied on the first and second toner transporting sheets 117 is quite large since the sheets 117 tend to scoop up a large mount of toner, namely the sheets 117 are so rigid as to not leave the inner surfaces of the first and second chambers 114*a* and 114*b*.

Secondly, the flow of the toner through the respective openings 115*a* and 115*b* is not smooth because the toner transporting direction, namely the clockwise direction in the drawings, and the direction of the toner flow through the respective openings 115*a* and 115*b* are different from each other. In some cases, the toner transported by the first toner transporting sheet will possibly return into the second chamber through the second opening. Still further, since the first and second toner transporting sheets 117 are constantly in contact with the inner surfaces of the chambers 114*a* and 114*b*, noise is generated due to the friction between the sheets and the inner surfaces of the chambers. Especially, when the sheets strike the upper walls after they have left the upper ends of the lower walls, a relatively loud noise is generated.

Thirdly, when the developing unit is used under conditions of high temperature and high humidity, the toner in the chambers tends to form a mass or to aggregate due to its moisture absorption so that the fluidity property of the toner is lowered and accordingly the toner image density may become poor.

Finally, the data obtained from the magnetic sensor is not reliable since, even when the amount of the toner in the first toner replenishing chamber is still enough, the magnetic sensor sometimes erroneously generates a signal representing the shortage of the toner in the first chamber. This is caused from the rotational timing of the pair of toner transporting sheets. According to the conventional arrangement as shown in FIG. 15, the rotational angle phases of the first and second sheets 116*a* and 116*b* are substantially the same, so that, at a stage where the amount of the toner in the first chamber 114*a* is reduced, when the first sheet 117 scoops the toner above the magnetic sensor 120, the area above the sensor 120 temporarily becomes vacant of the toner, and then some toner is replenished from the second chamber through the second opening 115*a* by the rotation of the second sheet 117. Accordingly, a sine curve 201 representing the voltage outputted from the sensor 120 shows a remarkable alternation with a broad amplitude in FIG. 10. Thus, according to the conventional arrangement, even though the first chamber 114*a* contains enough toner, the voltage represented by the sine curve 201 periodically is lowered below the threshold (S).

SUMMARY OF THE INVENTION

The object of the present invention is therefore to provide an improvement of the developing unit to solve these problems.

The essential object of the present invention is to reduce the torque for driving the toner transporting flexible sheets.

Another object of the present invention is to cause a smooth flow of the toner transported by the toner transporting flexible sheets from the second toner replenishing chamber into the first toner replenishing chamber and from the first toner replenishing chamber into the toner applying chamber.

Still another object of the present invention is to reduce the level of the noise generated between the first and second toner transporting sheets and the inner surfaces of the first and second toner replenishing chambers.

Still another object of the present invention is to prevent the toner from aggregating in the first and second toner replenishing chambers even under the conditions of high temperature and high humidity.

Still another object of the present invention is to improve the timing of the synchronization of the first and second toner transporting flexible sheets so that the amplitude of the sine curve-alternation of the amount of the toner in the first toner replenishing chamber is reduced at the stage where the amount of toner in the second chamber is reduced.

In order to achieve the aforementioned objectives, a developing unit according to the present invention, for use in an image forming apparatus, comprises a housing including at least two chambers, i.e. a toner applying chamber facing a photoreceptor and a first toner replenishing chamber for reserving toner to be transported into the toner applying chamber therefrom, and in addition with, preferably, a second toner replenishing chamber for reserving toner to be transported into the first toner replenishing chamber therefrom.

The housing includes therein at least one partition wall, and preferably at least two partition walls. The first partition wall defines a boundary between the toner applying chamber and the first toner replenishing chamber. The first partition wall has a first upper wall and a first lower wall between which is formed a first opening through which the toner reserved in the first replenishing chamber is transported into the toner applying chamber. On the other hand, the second partition wall defines a boundary between the first and second toner replenishing chambers and has a second upper wall and second lower wall between which is formed a second opening through which the toner reserved in the second replenishing chamber is transported into the first replenishing chamber.

First and second rotation frames are respectively disposed in the first and second toner replenishing chambers so as to rotate in an upward direction with respect to the first and second openings. Each rotation frame has a first arm extending radially.

First and second toner transporting flexible sheets are respectively attached to the end portions of the first arms of the first and second rotation frames so as to extend tangentially to a rotation circle of the corresponding frames and backwardly in the rotational direction of the frames. The first and second toner transporting flexible sheets have, respectively, an appropriate elasticity such that the sheets may rotate while deforming in the form of a circular arc. Each sheet includes a friction film which may bring the toner forward due to its friction against the toner.

With the arrangement of the developing unit, since the first and second toner transporting sheets transport the toner by frictional force applied on the toner while deforming in the form of a circular arc when each chamber is filled with the toner, a necessary small amount of toner is transported gradually. In other words, each sheet move the toner forwardly but no more than necessary, so that the torque for driving the frames with the sheets is reduced. On the other hand, when the amount of toner in the first and second chambers is reduced, the sheets can be restored to their original shapes to resiliently contact the inner surfaces of the chambers so that a reduced amount of toner on the bottom of the chambers can be carried by the restored sheets.

Preferably, each of the toner transporting flexible sheets comprises a base film connecting to the end portion of the first arm of the corresponding rotation frame, and the friction film laminated on a front surface of the base film. The base film is preferably made of polyphenylene sulfide which has an appropriate elastic restoring force and rigidity and which has little creep rupture even when it is used for a long period time of.

The friction film and the base film are preferably made of different materials and the friction film has, preferably, a higher coefficient of friction than that of the base film. The preferred material of the friction film is urethan which has superior sound-damping characteristics as well as excellent friction characteristics. The urethanfriction film can absorb a frictional noise generated between the respective toner transporting sheets and inner surfaces of the first and second toner replenishing chambers.

Each of the toner transporting flexible sheets may be provided, on the base film, with a noise absorption film in addition to the friction film. The noise absorption film is sandwiched between the base film and the friction film or on the base film neighboring the friction film.

Preferably, each of the rotation frames includes a second arm extending radially, and an agitation bar supported by the second arm in parallel relation with a rotational center axis of each frame. The second arm is designed long enough so that the agitation bar may rotate out of a circle region which is formed by a path of each toner transporting flexible sheet when each chamber is filled with the toner. It is noted that, when the toner transporting sheets rotate under the toner, the toner tends to be depressed by the rotating sheets to make an aggregation of the depressed toner. However, the depressed toner can be agitated by the agitation bar uniformly in the axial direction of the frames so that the smooth fluidity of toner can be maintained.

Preferably, there is provided a sensor, for example a magnetic sensor, on the bottom of the first toner replenishing chamber in order to detect the amount of toner in the first toner replenishing chamber. And, for obtaining the reliable output data from the sensor, it is preferable that the first and second rotation frames are respectively mounted in the corresponding chambers so that rotational phase angles thereof are different such that the first toner transporting sheet transports the toner above the sensor in synchronization with replenishing of the toner by the second toner transporting sheet from the second chamber into the first chamber through the second opening. The phase lag is, for example about 90°. According to this construction, the amplitude of the sine curve-output voltage produced by the sensor can be minimized and stabilized so that the output data may become reliable.

Preferably, the first and second upper walls respectively function as scrapers for scraping the toner carried upwardly by the first and second toner transporting sheets to introduce the toner into the toner applying chamber and the first toner replenishing chamber. Further, the distances of the lower ends of the first and second upper walls from the rotation axes of the first and second frames is preferably shorter than the distances of the upper ends of the first and second lower walls from the rotation axes, respectively. Still further, preferably the toner applying chamber includes a first block having a first toner guide surface which extends from the lower end of the first upper wall into the toner applying chamber to introduce the toner removed from the first toner transporting sheet by the first upper wall, from the first toner replenishing chamber into the toner applying chamber.

Preferably, the first toner guide surface extends close to a peripheral surface of the photoreceptor in order to introduce the toner deeply into the toner applying chamber. Further, the toner is preferably introduced, in association with the first guide surface, from the first toner replenishing chamber into an upper area of the toner applying chamber, which upper area is out of a toner-eddy-current area generated by rotation of the photoreceptor and the electrode roller. According to this arrangement, the toner-eddy-current area is not affected adversely.

The first toner replenishing chamber also preferably includes a second block having a second guide surface which extends from the lower end of the second upper wall into the first toner replenishing chamber to introduce the toner removed from the second toner transporting sheet by the second upper wall, from the second toner replenishing chamber into the first toner replenishing chamber.

Each of the first and second lower walls preferably has a third guide surface for slidably introducing the toner into the toner applying chamber from the first toner replenishing chamber or the first toner replenishing chamber from the second toner replenishing chamber.

Preferably, the first toner replenishing chamber includes a third upper wall for scraping the toner carried on the first toner transporting sheet, after having passing the first upper wall, in order to drop the toner into the first toner replenishing chamber. Instead, the first toner replenishing chamber may include a depression member for depressing and deeply deforming a proximal end portion of the first toner transporting sheet to slidably drop the toner on the sheet into the first toner replenishing chamber. Accordingly, the front surfaces of the flexible sheets advantageously receive little scrubbing from the depression member.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
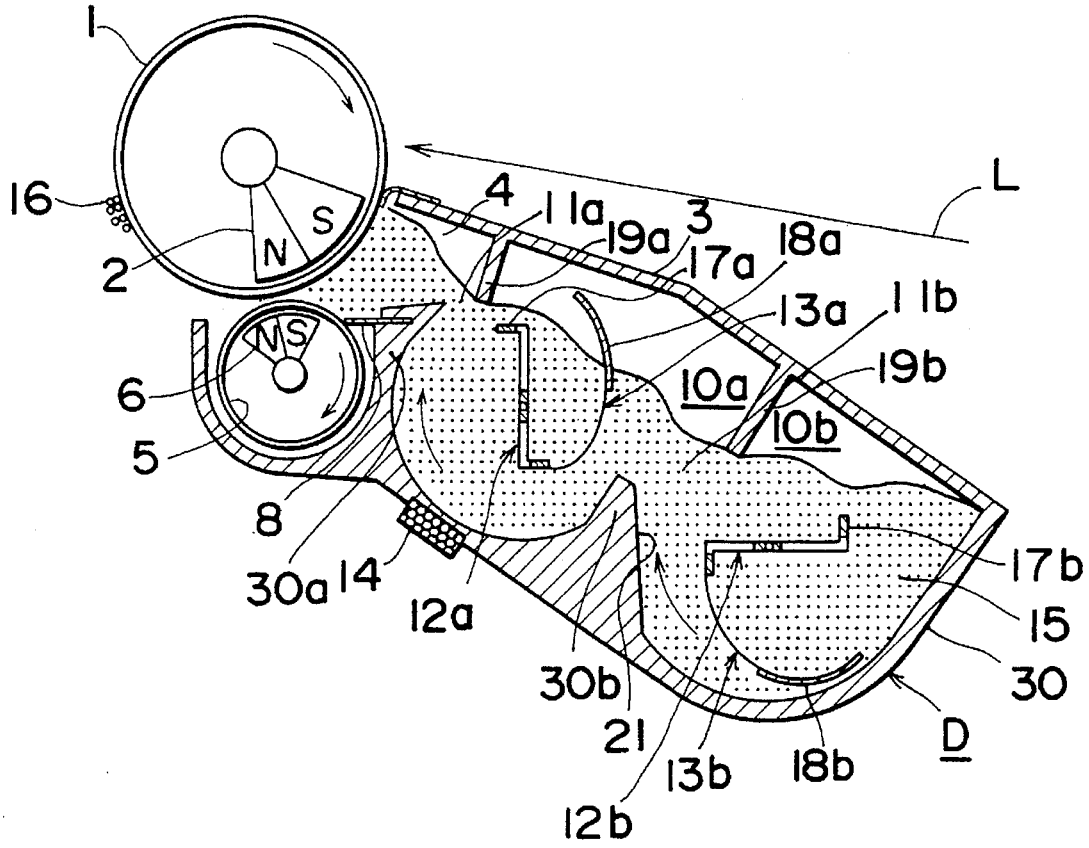
FIG. 1 is a sectional side view showing a developing unit located adjacent to a photoreceptor drum, according to a preferred embodiment of the present invention.
Figure 15:
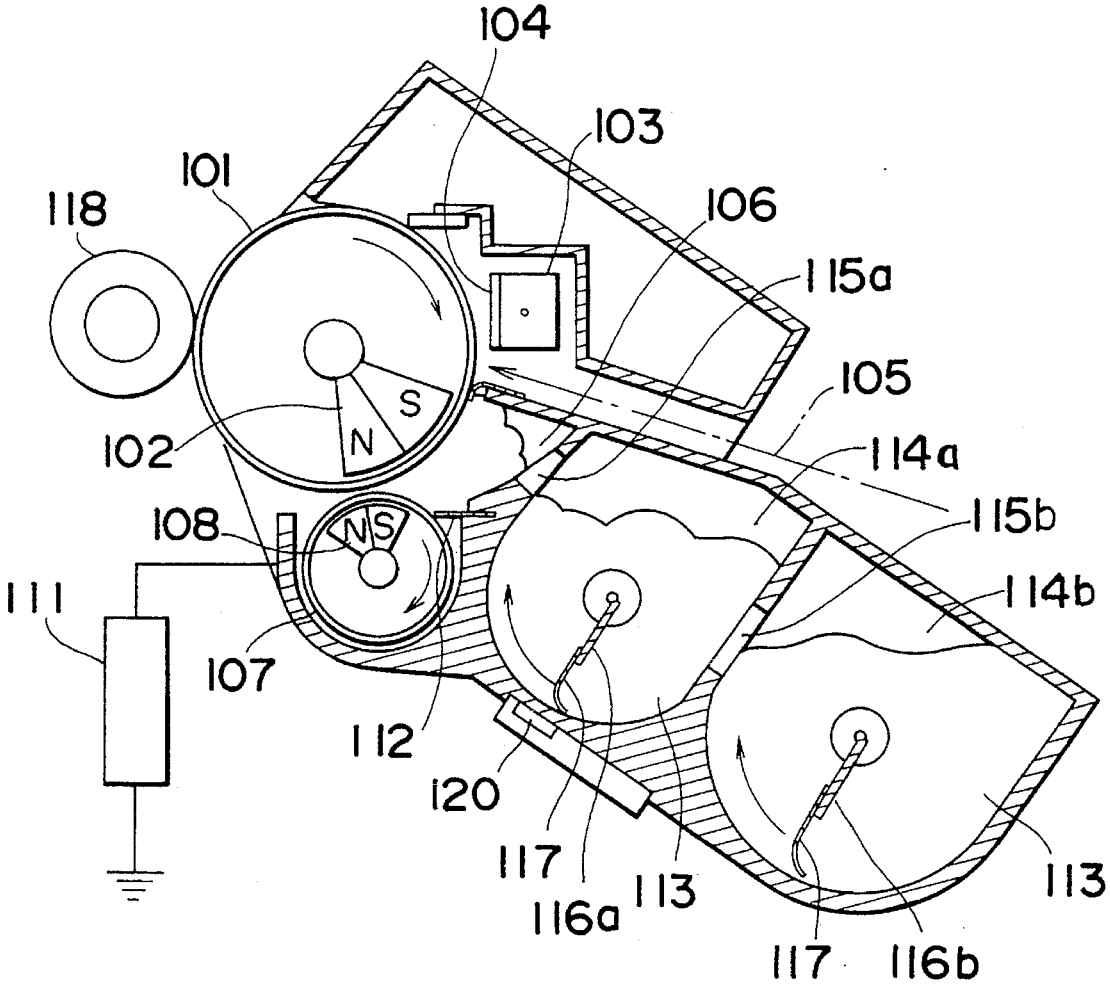
Fig. 15 PRIOR ART
FIG. 15 is an essential section of a conventional photographic copying machine including a developing unit, as previously described.

Referring to FIG. 1, there is shown a developing unit D according to a preferred embodiment of the present invention which is arranged next to a photoreceptor drum 1. Similarly to the conventional apparatus as shown in FIG. 15, the photoreceptor drum 1 is rotatable about its center axis in a direction indicated by an arrow and provided with a fixed magnet 2 therein.

The developing unit D is slantingly disposed below the passage of the laser beam L. The developing unit D has a housing 30 as a toner reservoir which is divided into three chambers 4, 10*a* and 10*b*, i.e. a toner applying chamber 4, a first toner replenishing chamber 10*a* and a second toner replenishing chamber 10*b*. An electrode roller 5 including a fixed magnet 6 therein is arranged in the toner applying chamber 4 such that a cylindrical surface of the roller 5 is close to the rotating surface of the drum 1. The roller 5 is rotatable in a direction indicated by an arrow. An electric voltage is applied on the roller 5 from an alternating current/high voltage source (not shown here).

The chambers 4 and 10*a* are separated by a first partition wall, and the chambers 10*a* and 10*b* are separated by a second partition wall. The first partition wall comprises a first lower wall 30*a* and a first upper wall 19*a* between which is defined a first opening 11*a* for allowing the toner 15 in the first toner replenishing chamber 10*a* to flow into the toner applying chamber 4. The second partition wall comprises a second lower wall 30*b* and a second upper wall 19*b* between which is defined a second opening 11b for allowing the toner 15 in the second toner replenishing chamber 10b to flow into the first toner replenishing chamber 10a.

Figure 2:
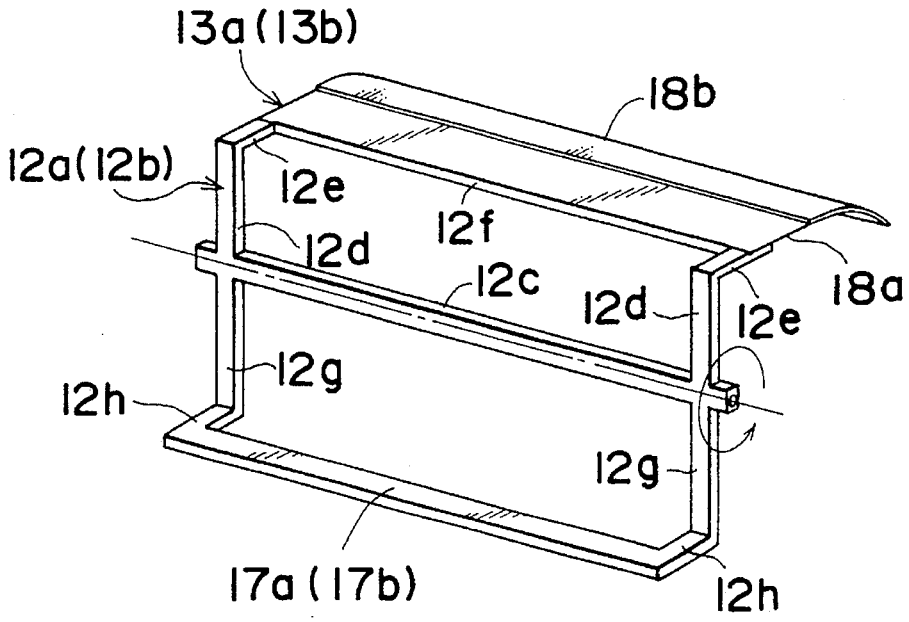
FIG. 2 is a perspective view showing a rotation frame with a toner transporting member and a toner agitation bar.

In each toner replenishing chamber 10a and 10b, there is provided a rotation frame 12a and 12b, to the end portion of which a toner transporting flexible sheet 13a and 13b is attached, as shown in detail in FIG. 2. Two rotation frames 12a and 12b are rotatably mounted on the housing 30 at a different angle phase of about 90°. Each frame 12a and 12b includes a center rotation shaft 12c and a pair of arms 12d and 12d extending radially from the both ends of the shaft 12C. Each arm 12d has an L-shaped end portion 12e. A bar member 12f traverses between the pair of L-shaped end portions 12a to constitute a mount means for supporting a toner transporting flexible sheet 13a and 13b which includes a flexible base film 18a, and a friction film 18b laminated on the tip portion of the base film 18a at its front side in the rotational direction of the frame. The base film 18a is preferably made of polyphenylene sulfide having high elastic restoring force sufficient to return to an original position even in a unfavorable environment such as high temperature and high humidity. The friction film 18b is preferably made of urethan. It is noted that the sheet 13a extends in the direction perpendicular to the pair of radial arms 12d, namely tangential to the rotational circle of the frames 12a and 12b.

Each of the rotation frames 12a and 12b also includes a second pair of arms 12g and 12g which extend radially in a direction opposite to the first pair of arms 12d and 12d. The second arms 12g is designed so as to be longer than the first arms 12d. Each of the second arms 12g has an L-shaped end portion 12h similar to the end portion 12e. An agitation bar 17a traverses between the second pair of end portions 12h.

A magnetism resistance type magnetic sensor 14 is built in the bottom wall of the first toner replenishing chamber 10a for the purpose of detecting the remaining amount of the toner in the first toner replenishing chamber 10a.

During operation, the rotation frames 12a and 12b rotate in the corresponding chambers 10a and 10b in a clockwise direction, as viewed in FIG. 1, along with the toner transporting sheets 13a and 13b.

Figure 3:
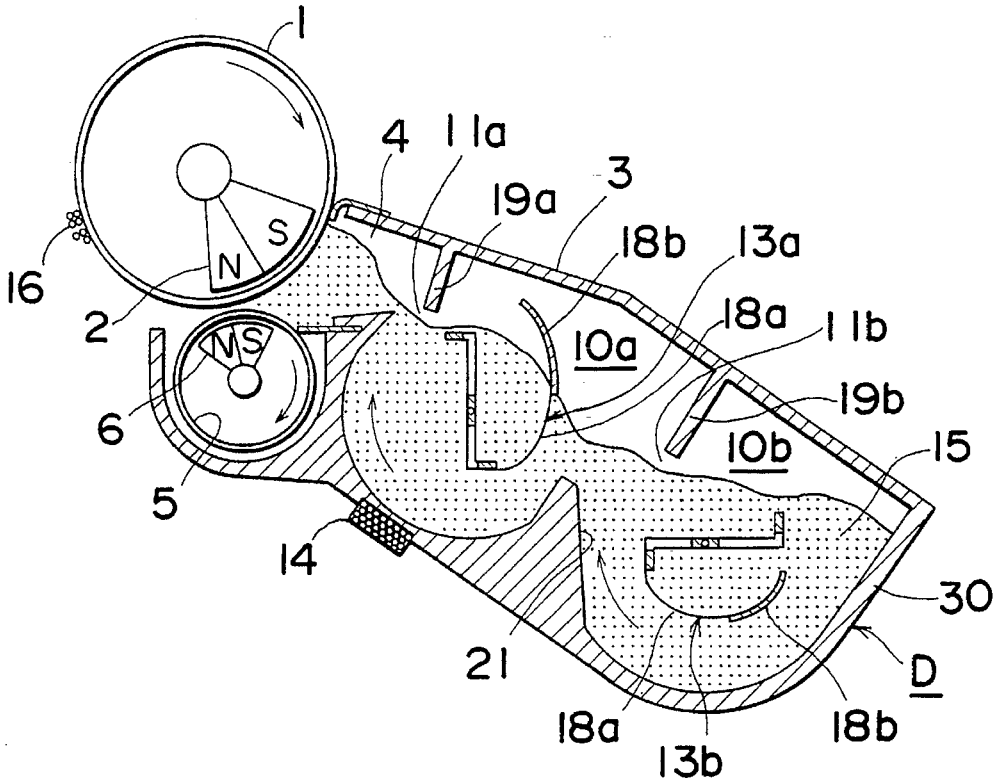
FIGS. 3 and 4 are sectional side views respectively similar to FIG. 1, showing the action of the first and second toner transporting members, wherein the amount of toner in the developing unit is larger in FIG. 3 than in FIG. 4, FIGS. 5 and 6 are sectional side views respectively similar to FIGS. 3 and 4, showing the flow of the toner caused by the action of the toner transporting members.

Referring to FIG. 3, there is shown a state in which the remaining amount of toner in the chambers 10a and 10b is relatively large, when the rotation frames 12a and 12b rotate in the corresponding chambers 10a and 10b, both toner transporting sheets 13a and 13b resiliently largely deform in the form of circular arc under the toner. Therefore, the sheets 13a and 13b do not generally contact the inner surface of the surrounding walls of the first and second chambers 10a and 10b. When the toner transporting sheets 13a and 13b rotate under the toner, the toner in contact with the sheets 13a and 13b, especially with the friction film 18b, is transported gradually in the clockwise direction due to the friction between the friction film 18b and the toner 15. Therefore, the resistance of the toner against the toner transporting sheets 13a is relatively small, so that the rotation frames 12a and 12b can be driven at a relatively small torque.

Figure 4:
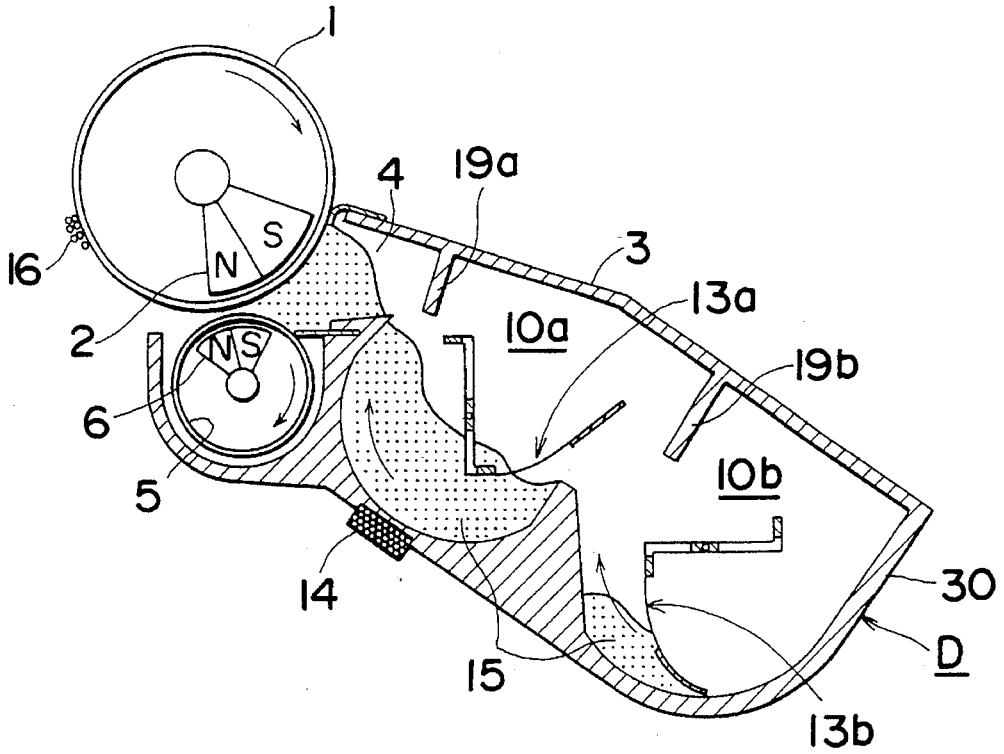

Contrary to the above, when the remaining amount of toner in the chambers 10a and 10b is reduced, as shown in the second chamber 10b in FIG. 4, the toner transporting sheet 13b tends to be restored to the original state, i.e. the flat state. Accordingly, the tip portion of the sheet 13b may contact the inner surface of the second chamber 10b. Even in the state as shown in FIG. 4, the sheet 13b may be curved and transport the toner in a clockwise direction by the frictional force of the friction film 18b.

According to the experiment carried out by the inventors, the base film 18a made of polyphenylene sulfide did not have any creep when it was used for a long time period under an environment such as a temperature of 33° C. and a humidity of 80% RH, so that the toner transporting condition was always appropriate in both cases when the remaining amount of toner is large or small.

Figure 5:
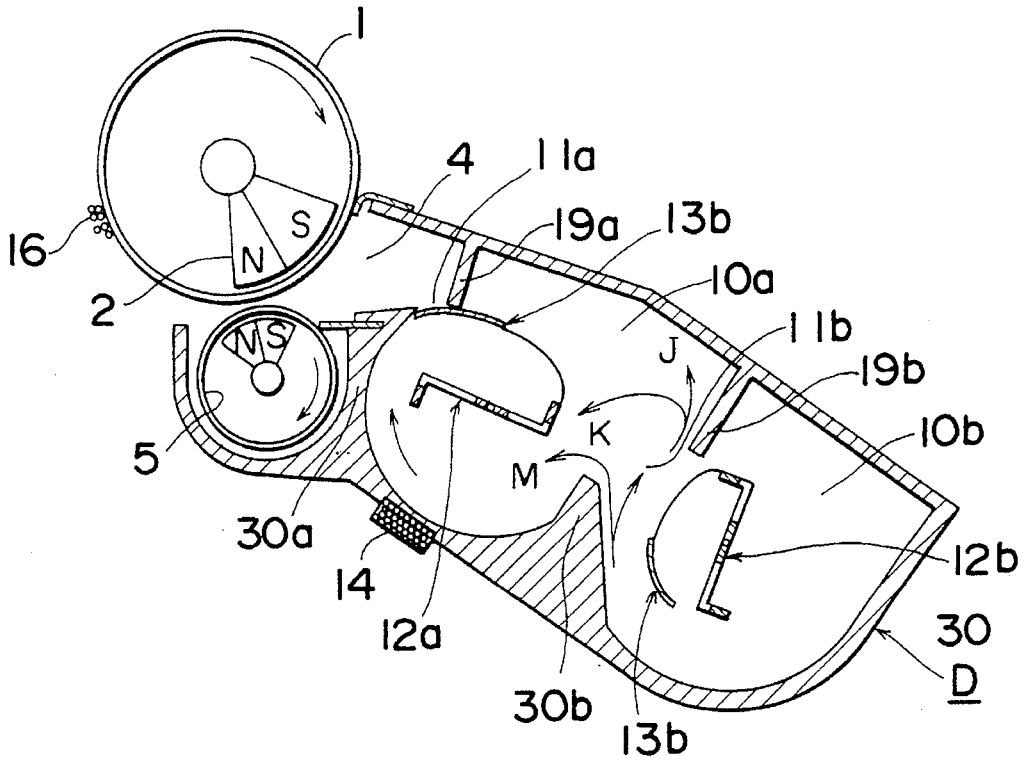
Figure 6:
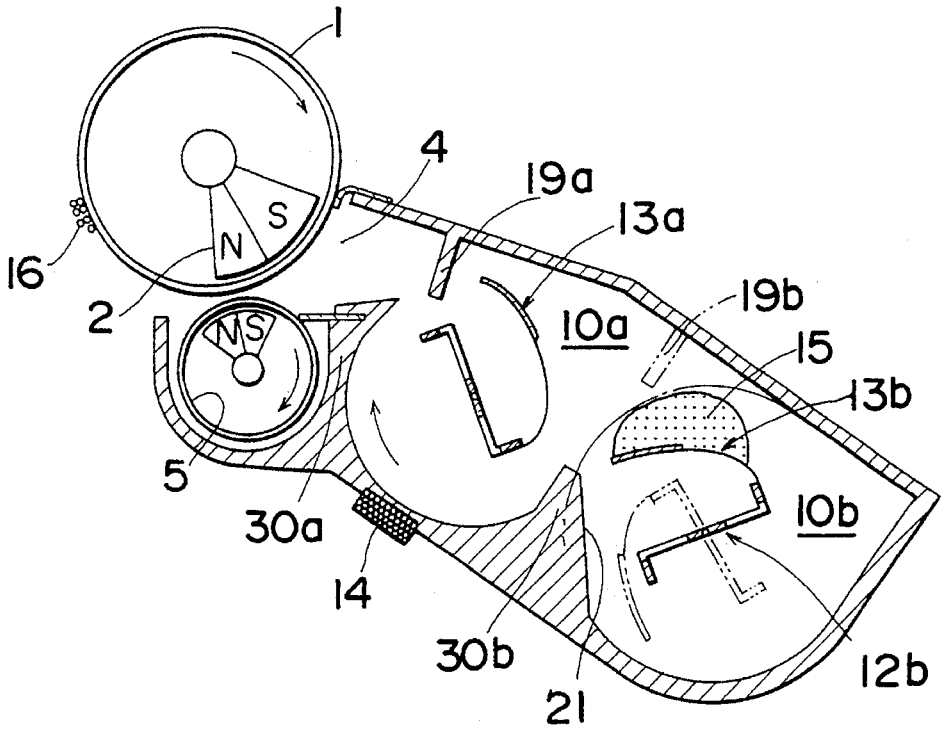
Figure 7:
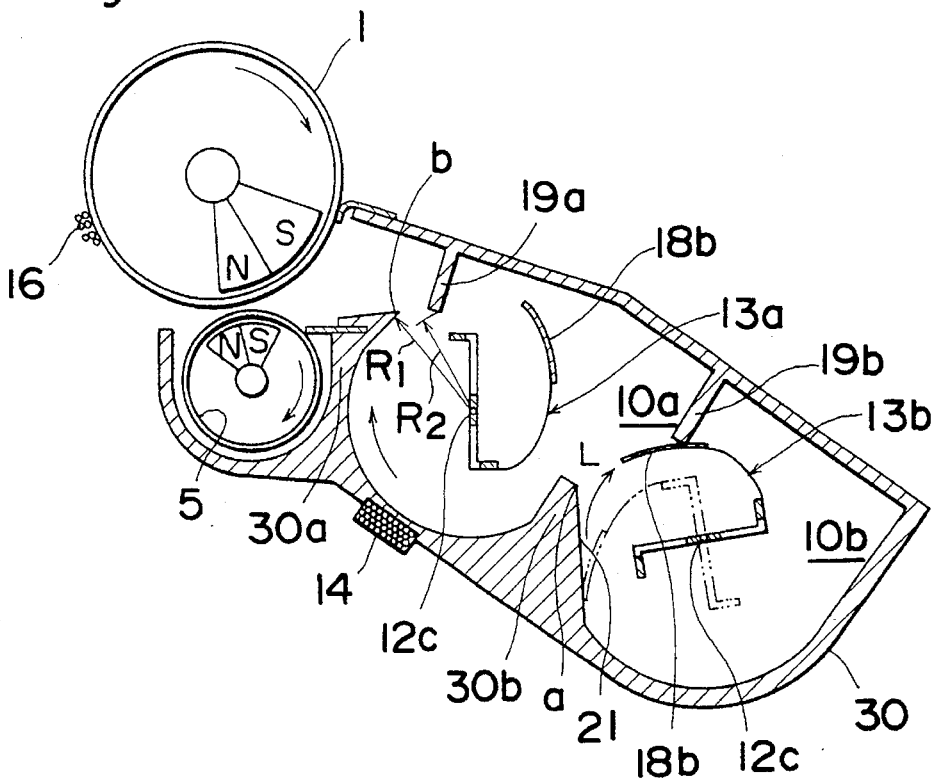
FIG. 7 is a sectional side view similar to FIG. 1, showing a state in which a part of the second toner transporting member is in contact with a lower end of a second projection.

FIG. 5 shows the flow of the toner generated by the action of the toner transporting sheets 13a and 13b. In FIGS. 5 and 6, the toner is not depicted for the reason of simplification. As shown in the drawings, the first and second upper walls 19a and 19b deviate, respectively, in the right direction in FIG. 5 from the corresponding first and second lower walls 30a and 30b. Thus, as shown in FIG. 7, each distance (R2) of the lower ends of the first and second upper walls 19a and 19b from each rotation axis (12c) of the first and second frames 12a and 12b is shorter than each distance (R1) of the upper ends of the first and second lower walls 30a and 30b from said each rotation axis (12c). Further, the second lower wall has a slanting guide surface 21 for toner at the side of the second chamber 10b.

FIG. 5 shows the state in which the first and second chambers 10a and 10b are sufficiently filled with the toner. When the second toner transporting sheet 13b, which is rotating about the center shaft 12c in a circular arc, comes close to the second opening 11b, the friction film 18b frictionally lifts up the toner that is in contact therewith. The upward movement of the tone is interrupted by the second upper wall 19b functioning as a scraper so that the toner begins flowing in a left-upper direction indicated by an arrow J through the second opening into the first chamber 10a, and the following toner flows in a direction indicated by an arrow K pushing up the proceeding toner in the direction J. When the second frame 12b rotates further, the friction film 18b of the sheet 13a strikes the second upper wall 19b in a snap action (see FIG. 7). According to the embodiment, it is advantageous that the friction film made of urethane and having a sufficient thickness can absorb the hitting shock and the noise to be generated. In this process the toner in the second chamber 10b is gradually transported in the first chamber 10a.

It is noted here that the second upper wall 19b is shifted to the side of the rotational center of the second frame 12b by a sufficient distance. If the second upper wall 19b was disposed further remote from the rotational center of the second frame 12b, as shown in FIG. 6, the second upper wall 19b would not work sufficiently as a scraper, thereby resulting in a part of the toner lifted due to the frictional force of the friction film 18b being returned into the second chamber 10b per se without moving into the first chamber 10a. Accordingly, it is apparent that the positioning of the second upper wall 19b according to the embodiment is effective for transporting the toner from the second chamber 10b into the first chamber 10b.

Returning to FIG. 5, the rotational movement of the second toner transporting sheet 13b also causes the flow of toner along the inner surface of the second chamber 10b. Accordingly, a slanting guide surface 21 is formed on the second lower wall 30b at its right side so that the toner above the bottom of the second chamber may smoothly slide on the guide surface 21 to enter the first chamber 10a. If such guide surface 21 was absent, the toner below the second opening 11b would tend to aggregate due to the repeated depression of the rotating sheet 13b.

The above description is made with respect to the second toner transporting sheet. However, since the first toner transporting sheet has the same function as the second transporting sheet, the first upper wall 19*a* is also disposed close to the rotational center of the first frame 12*a* so that the first upper wall 19*a* functions as a scraper against the toner lifted by the first toner transporting sheet 13*a* to introduce the toner into the toner applying chamber 4. It is preferable to provide a surface substantially the same as the slanting guide surface 21 on the first lower wall 30*a* to smoothly guide the toner from the first chamber 10*a* into the toner applying chamber 4, although it is not shown in the drawings.

Figure 8:
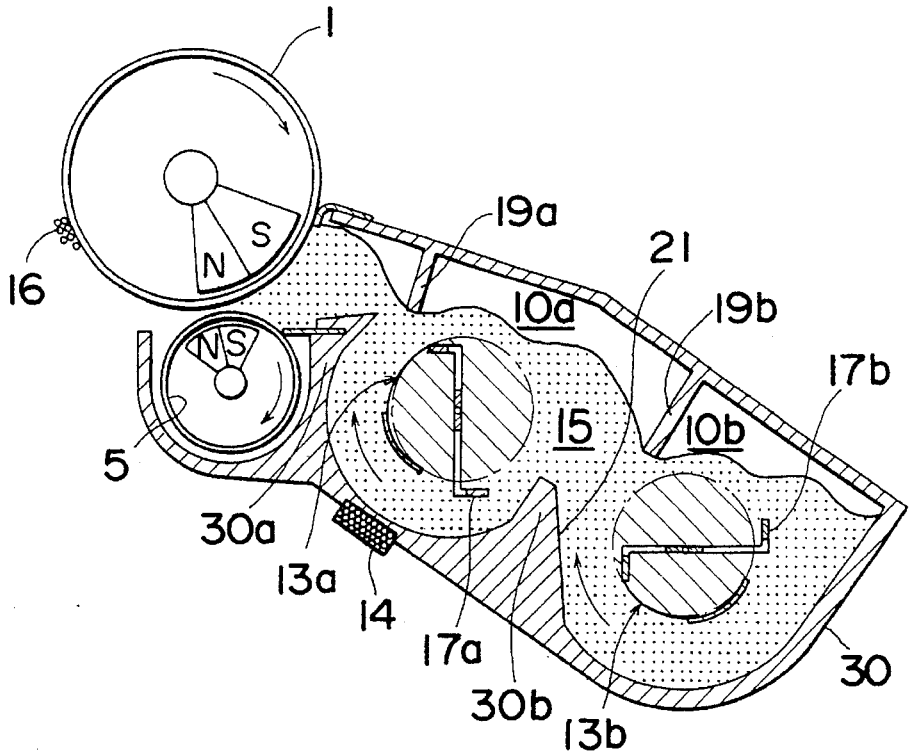
FIG. 8 is a sectional side view similar to FIG. 1, showing the action of the toner transporting members and the toner agitation bars.

Next, referring to FIG. 8, there is shown the function of the agitation bars 17*a* of the first and second rotational frame 12*a* when 12*b*. When the remaining amount of the toner is sufficient in the chambers 10*a* and 10*b*, the respective toner transporting sheets 13*a* and 13*b* make circular trace lines which are indicated by chain-line circles in FIG. 8. When the rotating sheets 13*a* and 13*b* transport the toner into the chambers 4 and 10*a*, the toner located just out of the chain-line circles is simultaneously depressed by the respective rotating sheets 13*a* and 13*b*, resulting in aggregation of the toner. However, since the agitation bars 17*a* of the first and second frames 12*a* and 12*b*, which are advantageously positioned radially further from the center shaft (12*c*) than the first and second toner transporting sheets 13*a* and 13*b*, pass out of the traced circles of the sheets 13*a* and 13*b*, the toner aggregating is agitated by the respective agitation bars 17*a* and 17*a* so that the density of the toner in the chambers can be kept uniform along the axis line of the rotational frame.

Figure 9:
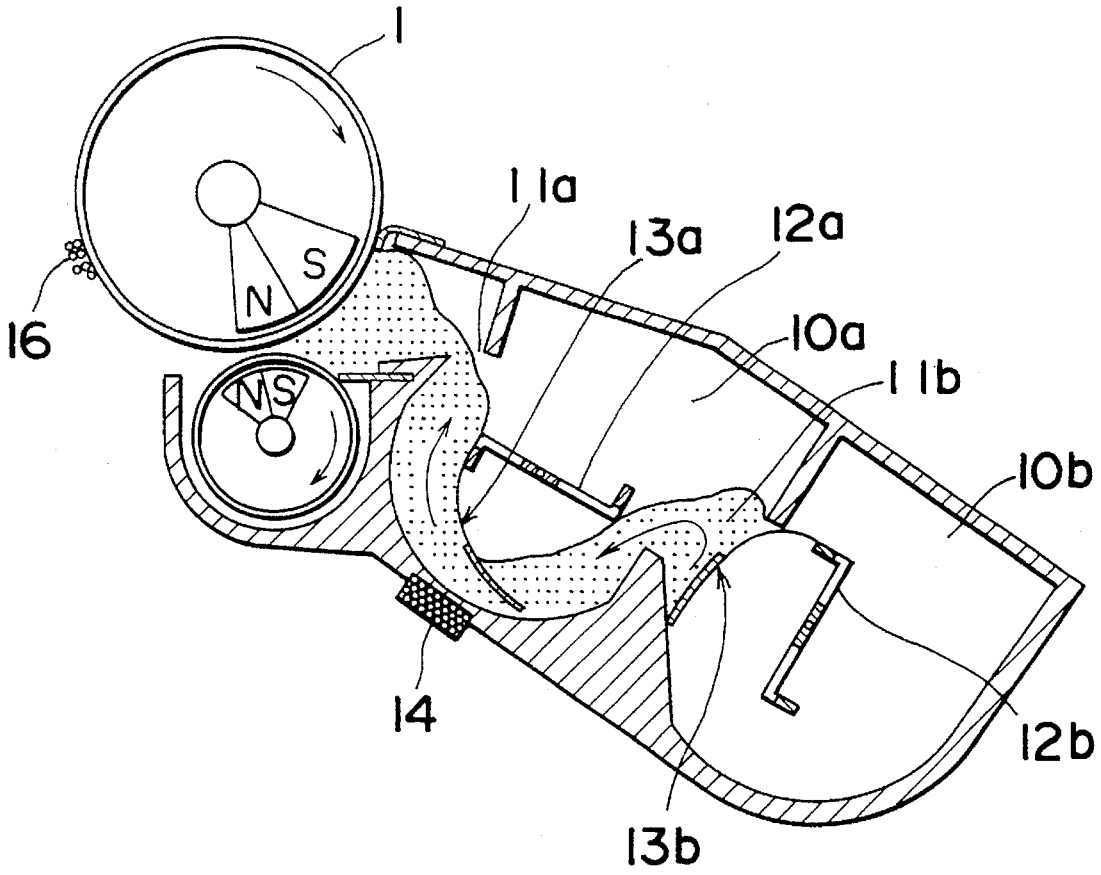
FIG. 9 is a sectional side view similar to FIG. 4, showing the synchronizing action of the first and second toner transporting sheets.
Figure 10:
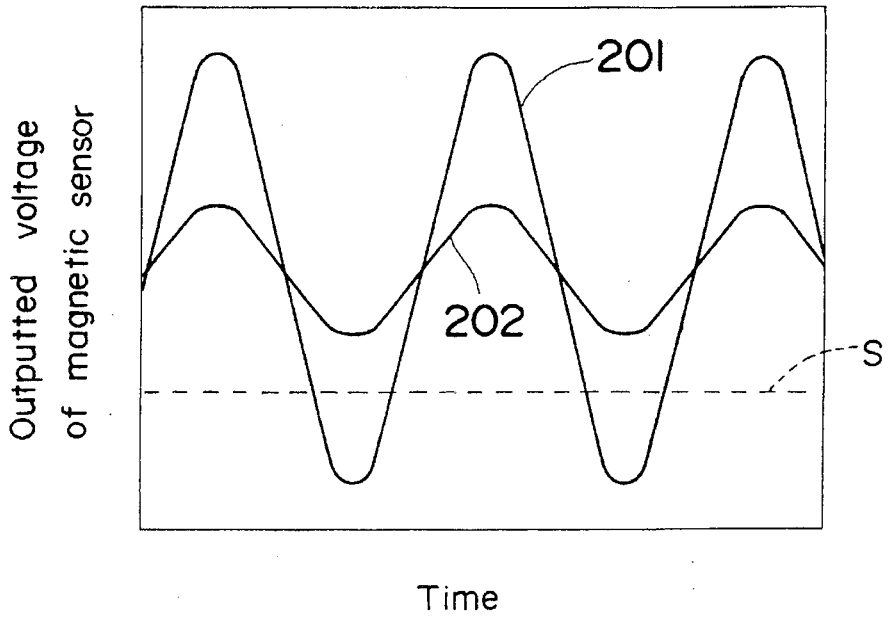
FIG. 10 is a graph showing an output from a magnetic sensor disposed on the bottom of a first toner chamber.

As apparent from FIGS. 1 and 3–8, and especially from FIG. 9, each time the first toner transporting sheet passes over the magnetic sensor 14 to transport the toner around the sensor 14 at the stage where the amount of the toner in the first chamber 10*a* has been reduced as shown in FIG. 9, the second toner transporting sheet timely replenishes the toner from the second chamber 10*b* into the first chamber 10*a*. Accordingly, the amount of the remaining toner above the sensor 14 does not undergo a large change, but rather changes gradually. This is represented in the graph of FIG. 10. The sine curve 202 represents the output voltage generated from the magnetic sensor 14 according to the embodiment. When compared with the other sine curve 201 representing that voltage according to the conventional developing unit of FIG. 15, it is apparent that the amplitude of the sine curve 202 is smaller than that of the conventional sine curve 201. In other words, the output voltage according to the embodiment is more stable. This means that erroneous detection by the magnetic sensor 14 can be reduced.

Figure 11:
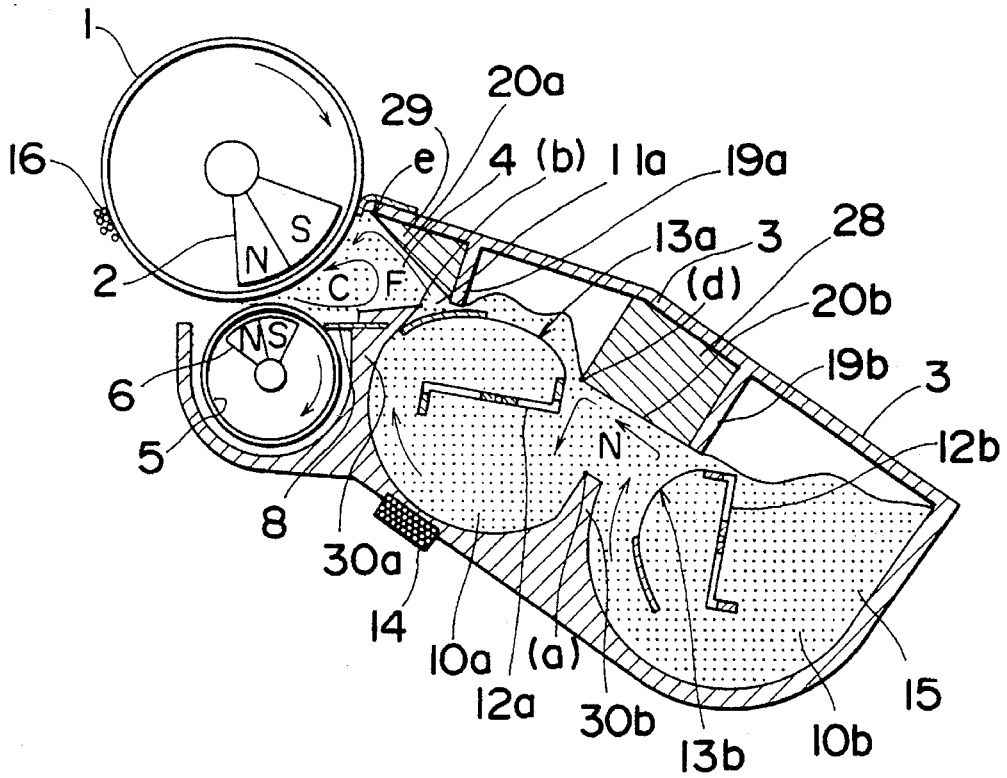
FIG. 11 is a sectional view similar to FIG. 1, showing a second embodiment of the present invention, wherein the flow of the toner caused by the action of the first and second toner transporting members is illustrated.
Figure 12:
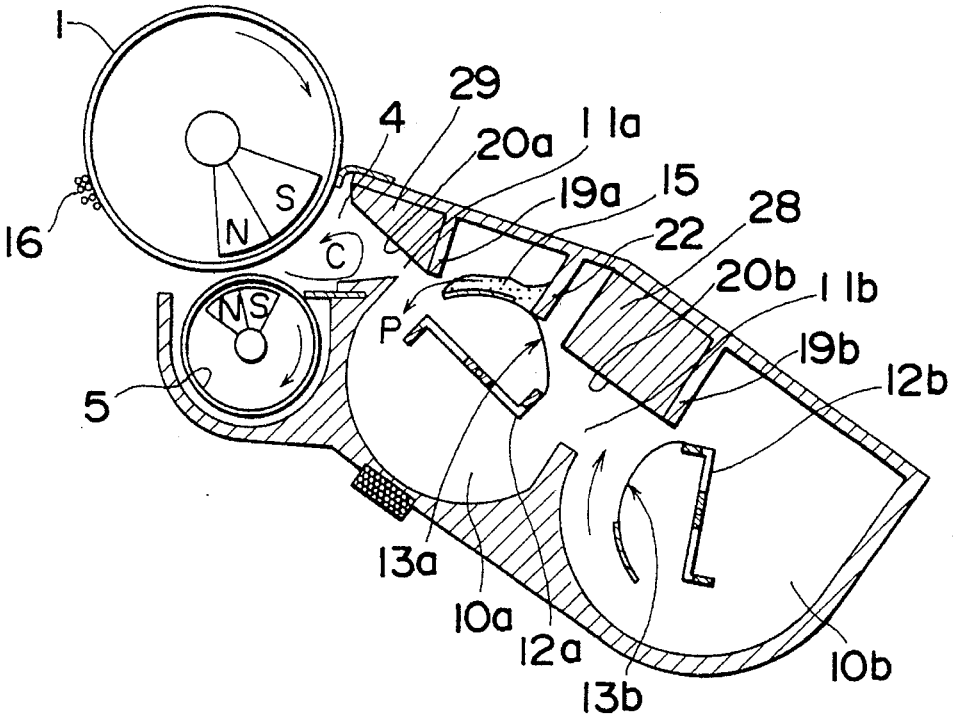
FIGS. 12 and 13 are sectional views similar to FIG. 10, respectively showing the modifications of the second embodiment.
Figure 13:
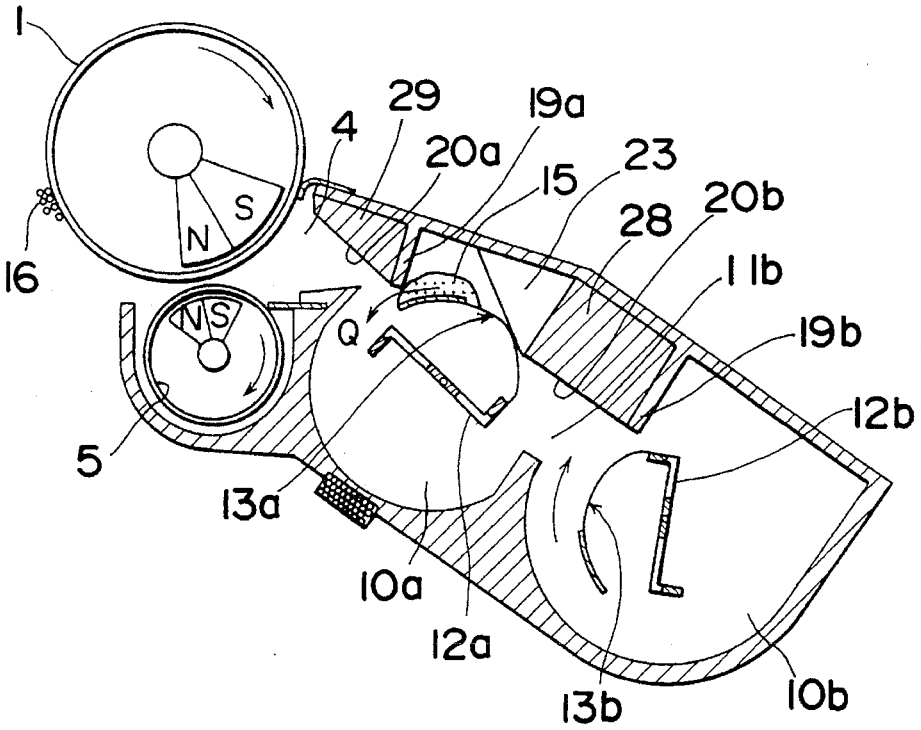

FIGS. 11, 12 and 13 illustrate, respectively, the other embodiment of the present invention.

The developing unit D according to the second embodiment as shown in FIG. 11 is different from that of the first embodiment in that there are provided toner guiding blocks 29 and 28, having the respective guide surfaces 20*a* and 20*b*. The first block 29 having the first guide surface 20*a* is disposed in the toner applying chamber 4 at its upper corner so as to contact the sealing wall 3 and the first upper wall 19*a*. The first guide surface 20*a* extends slantingly in the left upper direction from the lower end of the first upper wall 19*a*, namely from the upper end of the first opening 11*a* such that the left end (e) is positioned very close to the photoreceptor 1 and remote from the upper right end (b) of the first lower wall 30*a*. Similarly to the above, the second block 28 having the second guide surface 20*b* is disposed in the first toner replenishing chamber 10*a* at its upper corner so as to contact the sealing wall 3 and the first upper wall 19*b*. The second guide surface 20*b* extends slantingly in the left upper direction from the lower end of the second upper wall 19*b*, namely from the upper end of the second opening 11*b* so as to exceed the top point (a) of the second lower wall 30*b*. Thus, the left end (d) of the second guide surface 20*b* is positioned at the left side of the top point (a).

According to the first embodiment shown in FIG. 5, the toner depressed into the corner, which is defined by the second upper wall 19*b*, by the second toner transporting sheet disadvantageously tends to drop into the second chamber 10*b*. On the contrary, according to the second embodiment shown in FIG. 11, the toner scraped by the second upper wall 19*b* can smoothly flow in a direction indicated by an arrow N along the second guide surface 20*b*. Therefore, the amount of the toner returning into the second chamber 11*b* can be reduced.

Similarly, the toner scraped by the first upper wall 19*a* can smoothly flow upwardly obliquely toward the photoreceptor 1 into the toner applying chamber 4. As shown in FIG. 11, the first guide surface 20*a* is disposed upwardly out of a region in which an eddy current C of the toner is generated in the toner applying chamber 4 due to the rotation of the photoreceptor 1 and the electrode roller 5 so that the eddy current C of the toner is not affected by the flow of the toner along the first guide surface 20*a*. Thus, uniform application of the toner onto the surface of the photoreceptor 1 is ensured.

FIG. 12 illustrates a third embodiment of the present invention in which a third upper wall 22 as a scraper is formed between the first and second upper walls 19*a* and 19*b* so as to be suspended from the sealing wall 3 of the housing 30. As described above, most of the toner lifted by the first sheet 13*a* is scraped by the first upper wall 19*a*. However, a small amount of toner 15 may move clockwise past the first upper wall 19*a* while bearing on the first sheet 13*a*, as shown in FIG. 12. Such remaining toner 15 may return into the second chamber through the second opening 11*b*, in accordance with the first embodiment. On the contrary, according to the second embodiment as shown in FIG. 11, the end portion (d) of the second block 28 may the scrape toner being carried on the first sheet 13*a*. In the third embodiment, the third upper wall 22 positively scrapes the toner on the first sheet 13*a* at a position closer to the first upper wall 19*a* than the second block 28 to completely scrape the toner to drop in a direction P into in the first chamber 10*a*.

Figure 14:
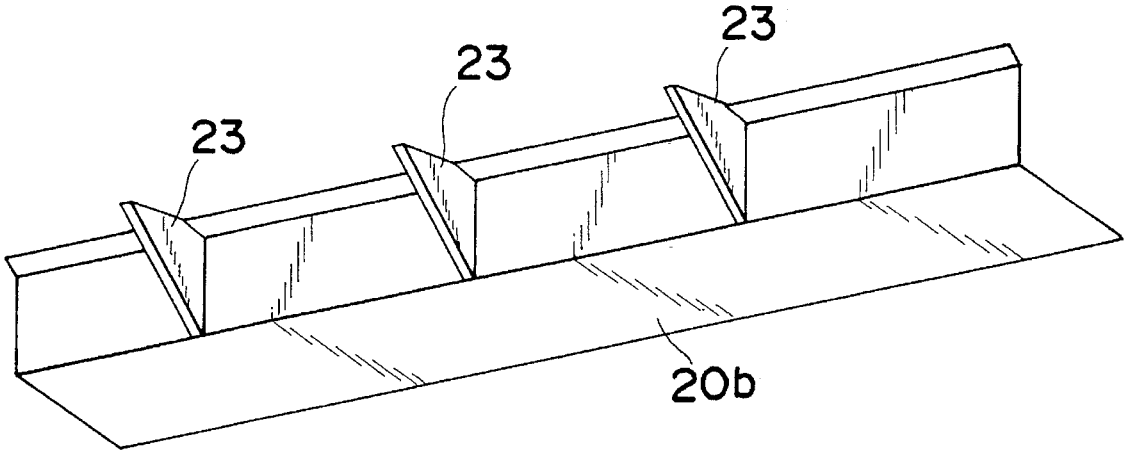
FIG. 14 is a perspective view showing an urging member for depressing the toner transporting member which is employed in FIG. 13.

FIG. 13 illustrates a fourth embodiment of the present invention which has the same object as the third embodiment. According to the fourth embodiment, a depression member 23 is disposed at the corner defined by the second block 28 and the sealing wall 3 of the housing 30. The depression member 23, shown in detail in FIG. 14, includes three triangular ribs 23*a* spaced apart from one another. As shown in FIG. 13, when the first sheet 13*a* , carrying some amount of toner 15, rotates clockwise and passes the first upper wall 19*b*, the proximal portion of the sheet 13*a* bears on the triangular ribs 23*a* so as to be elastically deformed so that the toner 15 on the first sheet 13*a* drops in a direction indicated by an arrow Q sliding down the first sheet 13*a*. The fourth embodiment has an advantage that since the rib plates 23*a* do not scrub the entire surface of the first sheet 13*a*, the mechanical stress on the sheet 13*a* is advantageously relatively small.

Although the present invention has been fully described in connection with the preferred embodiments thereof with reference to the accompanying drawings, it is to be noted that various changes and modifications will be apparent to those skilled in the art. For example, the material of the base film 18*a* may be an elastic resin such as polyester resin, or the base film 18*a* may be replaced by a springy metal such as a thin plate of phosphor bronze. Further, two separate films, i.e. an impact-sound absorbing film and a frictional film may be laminated on the base film 18*b* so as to neighbor one another. Although the above description relates to a magnetic cascade development system according to the embodiments described above, it is needless to say that the present invention can be applied to different types of developing system. Therefore, such changes and modifications are to be understood as included within the scope of the present invention as defined by the appended claims unless they depart therefrom.

What is claimed is:

1. A developing unit for use in an image forming apparatus, said developing unit comprising:

a housing including a toner applying chamber for applying toner to a photoreceptor and a toner replenishing chamber for reserving toner to be transported into said toner applying chamber therefrom;

a partition wall defining a boundary between said toner applying chamber and said toner replenishing chamber and having an upper wall and a lower wall between which is formed an opening through which the toner reserved in said toner replenishing chamber is transported into said toner applying chamber;

a rotation frame disposed in said toner replenishing chamber so as to rotate about a rotation axis in an upward direction with respect to said opening, said rotation frame having an arm extending radially from said rotation axis; and a toner transporting flexible sheet attached to an end portion of said arm of said rotation frame so as to extend tangentially to a rotation circle of said frame and backwardly with respect to a rotational direction of said frame;

said toner transporting flexible sheet having an appropriate elasticity such that said sheet may deform into a form of a circular arc during rotation, and said sheet including a friction film which may bring the toner forwardly due to friction between the toner and said friction film.

2. The developing unit as claimed in claim 1, wherein said toner transporting flexible sheet comprises a base film connecting to said end portion of said arm of said rotation frame, and said friction film laminated on a front surface of said base film.

3. The developing unit as claimed in claim 2, wherein said base film is made of polyphenylene sulfide.

4. The developing unit as claimed in claim 2, wherein said friction film has a higher coefficient of friction than that of said base film.

5. The developing unit as claimed in claim 1, wherein said friction film is made of urethan.

6. The developing unit as claimed in claim 1, wherein said friction film also has a function of absorbing a frictional noise generated between said toner transporting sheet and an inner surface of said toner replenishing chamber.

7. The developing unit as claimed in claim 2, wherein said toner transporting flexible sheet further comprises a noise absorption film sandwiched between said base film and said friction film or on said base film neighboring said friction film.

8. The developing unit as claimed in claim 1, wherein said arm of said rotation frame constitutes a first arm, and said rotation frame further includes a second arm radially extending from said rotation axis, and an agitation bar supported by said second arm in parallel relation with said rotational axis of said frame, said second arm being long enough so that the agitation bar may rotate out of a circle region which is formed by a path of said toner transporting flexible sheet when said toner replenishing chamber is filled with the toner.

9. The developing unit as claimed in claim 1, further comprising a sensor, disposed on a bottom of said toner replenishing chamber, for detecting an amount of toner in said toner replenishing chamber.

10. The developing unit as claimed in claim 1, wherein said upper wall functions as a scraper for scraping the toner upwardly carried by said toner transporting sheet to introduce the toner into said toner applying chamber.

11. The developing unit as claimed in claim 10, wherein a distance of a lower end of said upper wall from said rotation axis of said frame is shorter than a distance of an upper end of said lower wall from said rotation axis.

12. The developing unit as claimed in claim 10, wherein said toner applying chamber includes a block having a toner guide surface which extends from a lower end of said upper wall into said toner applying chamber to introduce the toner removed from said toner transporting sheet by said upper wall, from said toner replenishing chamber into said toner applying chamber.

13. The developing unit as claimed in claim 12, wherein said toner guide surface extends to a position close to a peripheral surface of the photoreceptor.

14. The developing unit as claimed in claim 13, wherein said toner applying chamber further comprises an electrode roller which is disposed therein and below the photoreceptor to remove the toner applied on a non-image area of the photoreceptor therefrom, and the toner is transported from said toner replenishing chamber into an upper area of said toner applying chamber, which upper area is out of a toner-eddy-current area generated by rotation of the photoreceptor and the electrode roller, in cooperation with said toner guide surface.

15. The developing unit as claimed in claim 10, wherein said lower wall has a guide surface for slidably introducing the toner into said toner applying chamber from said toner replenishing chamber.

16. The developing unit as claimed in claim 1, wherein said toner replenishing chamber, said partition wall, said upper wall, said lower wall, said opening, said rotation frame, said rotation axis and said toner transporting flexible sheet respectively constitute a first toner replenishing chamber, a first partition wall, a first upper wall, a first lower wall, a first opening, a first rotation frame, a first rotation axis and a first toner transporting flexible sheet, and wherein said housing further includes:

a second toner replenishing chamber for receiving toner to be transported into said first toner replenishing chamber therefrom;

a second partition wall defining a boundary between said first and second toner replenishing chambers and having a second upper wall and a second lower wall between which is formed a second opening through which the toner reserved in said second replenishing chamber is transported into said first replenishing chamber;

a second rotation frame disposed in said second toner replenishing chamber so as to rotate about a second rotation axis in an upward direction with respect to said first and second openings, said second rotation frame having an arm extending radially from said second rotation axis; and a second toner transporting flexible sheet having an appropriate elasticity such that said second sheet may deform into a form of a circular arc during rotation, and said second sheet including a friction film which may bring the toner forwardly due to friction between the toner and said friction film of said second sheet.

17. The developing unit as claimed in claim 16, wherein said first and second rotation frames are respectively mounted in said first and second toner replenishing chambers so that rotational phase angles thereof are different such that said first toner transporting sheet transports the toner above said sensor in synchronization with replenishing of the toner by said second toner transporting sheet from said second toner replenishing chamber into said first toner replenishing chamber through said second opening.

18. The developing unit as claimed in claim 16, wherein said second upper wall functions as a scraper for scraping the toner upwardly carried by said second toner transporting sheet to introduce the toner into said first toner replenishing chamber, a distance of a lower end of said second upper wall from said second rotation axis is shorter than a distance of an upper end of said second lower wall from said second rotation axis, and said first toner replenishing chamber includes a block having a guide surface which extends from said lower end of said second upper wall into said first toner replenishing chamber to introduce the toner removed from said second toner transporting sheet by said second upper wall, from said second toner replenishing chamber into said first toner replenishing chamber.

19. The developing unit as claimed in claim 16, wherein said first toner replenishing chamber includes another upper wall for scraping the toner carried on said first toner transporting sheet, after having passed said first upper wall, in order to drop the toner into said first toner replenishing chamber.

20. The developing unit as claimed in claim 16, wherein said first toner replenishing chamber includes a depression member for depressing and deeply deforming a proximal end portion of said first toner transporting sheet to slidably drop the toner on said first toner transporting sheet into said first toner replenishing chamber.

* * * * *